US006421884B2

(12) United States Patent
Pinto

(10) Patent No.: US 6,421,884 B2
(45) Date of Patent: Jul. 23, 2002

(54) NON-WOVEN FABRIC FORMING SYSTEM

(76) Inventor: Akiva Pinto, P.O. Box 1100-171, Gastonia, NC (US) 28053-1100

( * ) Notice: Subject to any disclaimer, the term of this patent is extended or adjusted under 35 U.S.C. 154(b) by 0 days.

(21) Appl. No.: 09/852,514

(22) Filed: May 10, 2001

Related U.S. Application Data

(63) Continuation-in-part of application No. 09/760,925, filed on Jan. 16, 2001, now Pat. No. 6,276,028, which is a continuation-in-part of application No. 09/505,922, filed on Feb. 17, 2000, now Pat. No. 6,263,545.

(51) Int. Cl.[7] ..... D01G 15/40

(52) U.S. Cl. ..... 19/105; 19/65 A; 19/97.5; 19/200

(58) Field of Search ..... 19/65 A, 90, 92, 19/97, 98, 105, 106 R, 97.5, 145.5, 145.7, 161.1, 200, 203, 204, 205, 296, 300, 302, 303, 304

(56) References Cited

U.S. PATENT DOCUMENTS

| | | | | | |
|---|---|---|---|---|---|
| 4,045,091 A | | 8/1977 | Beneke | 302/28 |
| 4,301,572 A | | 11/1981 | Miyamoto | 19/97 |
| 4,394,789 A | | 7/1983 | Egerer | 19/97 |
| 4,403,374 A | | 9/1983 | Wood | 19/105 |
| 4,520,530 A | | 6/1985 | Pinto | 19/105 |
| 4,520,531 A | * | 6/1985 | Hergeth | 19/105 |
| 4,574,433 A | | 3/1986 | Brunnschweiler | 19/105 |
| 4,694,538 A | * | 9/1987 | Pinto et al. | 19/105 |
| 4,709,451 A | | 12/1987 | Leifeld | 19/105 |
| 5,297,316 A | * | 3/1994 | Bernhardt et al. | 19/105 |
| 5,701,637 A | | 12/1997 | Graf | 19/114 |
| 5,950,282 A | * | 9/1999 | Pinto | 19/105 |

* cited by examiner

*Primary Examiner*—John J. Calvert
*Assistant Examiner*—Gary L. Welch
(74) *Attorney, Agent, or Firm*—Flint & Flint, P.A.

(57) ABSTRACT

An arrangement for forming non-woven fiber fabrics or webs having high resilience and loft with substantially equal fiber orientation in all directions and substantially equal fiber density throughout. The arrangement includes a fiber web forming chute having upper and lower walls arranged in a substantially upright position. Each of the upper and lower wall includes a fiber movement assist mechanism which acts to assist movement of the fibers toward the exit end of the forming chute in a manner which assists in the control of the fiber orientation and the density of the fiber web being formed. The arrangement further includes an air flow mechanism which directs an air flow through the forming chute during the forming operation. The air flow may or may not be treated.

21 Claims, 3 Drawing Sheets

NON-WOVEN FABRIC FORMING SYSTEM

This is a continuation-in-part of my earlier filed application Ser. No. 09/760,925, filed on Jan. 16, 2001, now U.S. Pat. No. 6,276,028 which is a continuation-in-part of Ser. No. 09/505,922 filed on Feb. 17, 2000, now U.S. Pat. No. 6,263,545.

BACKGROUND OF THE INVENTION

The instant invention is directed to a system for forming non-woven fabric or fiber webs of evenly and throughly blended fibers.

Fiber webs or non-woven fabrics are well known throughout the textile industry. Normally, these webs or fabrics are formed by producing carded or air lay webs and passing a plurality of these webs through a cross-lapper to produce the fiber web of sufficient height with entangled fibers for web unity. A major drawback to this system is that the fiber directions are generally in line with the direction of carding thus placing the fibers of the stacked or lapped webs in X,Y positions. This results in a web with a spring-like action.

Another problem with this type of system is that production is limited to the speed of the cross-lapping machine.

It is the object of the instant invention to provide a system capable of producing a fabric web or non-woven fabric in which the fibers are disposed and entangled in all directions thus forming a more stable fabric or web.

Another object of the invention is a system capable of producing non-woven fabrics or fabric webs of even density at increased speeds.

Another object of the invention is the production of a non-woven fabric suitable for use as insulation material and slitted material in the height direction.

Another object of the invention is the production of a non-woven fabric in which the fibers are oriented to provide isotropic strength properties to the fabric.

Another object of the invention is a system for producing non-woven fabrics or fiber webs with equal density through its height and width.

Another object of the invention is to provide a system for producing non-woven fabrics or fiber webs of high density without a cross-lapper.

Another object of the invention is to provide a system for the production of non-woven webs or fabrics structured with sufficient stability, loft, and resilience to be used as pillow stuffing, upholstery padding, mattress stuffing and other similar products.

Another object of the invention is a system for the production of non-woven webs in which the web is treated during formation in the forming chute with desired materials.

SUMMARY OF THE INVENTION

The invention is directed to an arrangement for forming a non-woven fabric with high resilience and a high loft. The arrangement includes a cabinet which receives opened and blended fibers from a fiber feed. Connected with the cabinet is an upwardly directed fiber web forming chute for receiving the opened and blended fibers and forming them into a non-woven fiber web. The forming chute has an upper wall which includes a vibrating plate and a lower wall which includes a packing belt for urging the fibers down the forming chute in an evenly distributed condition throughout the height of the fiber web being formed. An air distribution system is associated with the arrangement for delivering air flow through the forming chute which assists in controlling the distribution and movement of the fibers within the forming chute. The air flow exits the forming chute through its upper wall.

The upper wall includes a hood over the vibrating plate for receiving the air flow through the upper wall. Also, the vibrating plate is perforated which allows the air flow to migrate through the vibrating plate into the hood. The air distribution system includes an outlet conduit which delivers the air flow into the cabinet and into the receiving end of the forming chute. An intake conduit is provided for removing the air flow for the cabinet.

The air distribution system may include a feed unit for supplying to the air flow various elements such as moisture or chemical additives which mingle with and coat fibers within the forming chute. An arrangement for forming a non-woven fabric web with high resilience and high loft including a housing delivering blended and opened fibers into a receiving end of a fiber web forming chute. The forming chute includes an upper wall and a lower wall which are spaced a distance equal the loft of the fiber web. The upper wall comprises a vibrating plate positioned adjacent an upper packing belt. The vibrating plate and upper packing belt each extend across the width of the forming chute and in tandem along its length.

The lower wall also includes a fiber movement assisting element.

The fiber movement assisting element, the vibration plate, and the upper packing belt cooperate to move the fibers within the forming chute to form a fiber web in which the fibers are oriented in all directions and with substantial equal density throughout.

The vibrating plate is located adjacent the receiving end while the upper packing belt is located adjacent a delivery end of the forming chute.

An air system which provides an air flow through the housing and the forming chute may be associated with the arrangement. It may include an air return associated with the upper wall.

An arrangement for forming a non-woven fabric with high resilience and high loft comprising a housing delivering opened and blended fibers into a receiving end of an upwardly extending fiber web forming chute. The forming chute has an upper wall spaced from a lower wall by a distance equal to the loft of the fiber web. The lower wall includes a packing belt which extends across its width and substantially along its entire length. The upper wall comprises a vibrating plate and an upper backing belt each extends across the width of the forming chute and along the length of the upper wall. An air system may be included to provide an air flow through the housing and forming chute. The air system may be a closed system or an open end system.

The upper packing belt extends along substantially the entire length of the upper wall and the vibrator plate extends along substantially the entire length of said upper wall. The vibrator plate carries the upper packing belt by way of a pair of rolls mounted on opposed ends. One or both of the rolls are driven.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 1A:
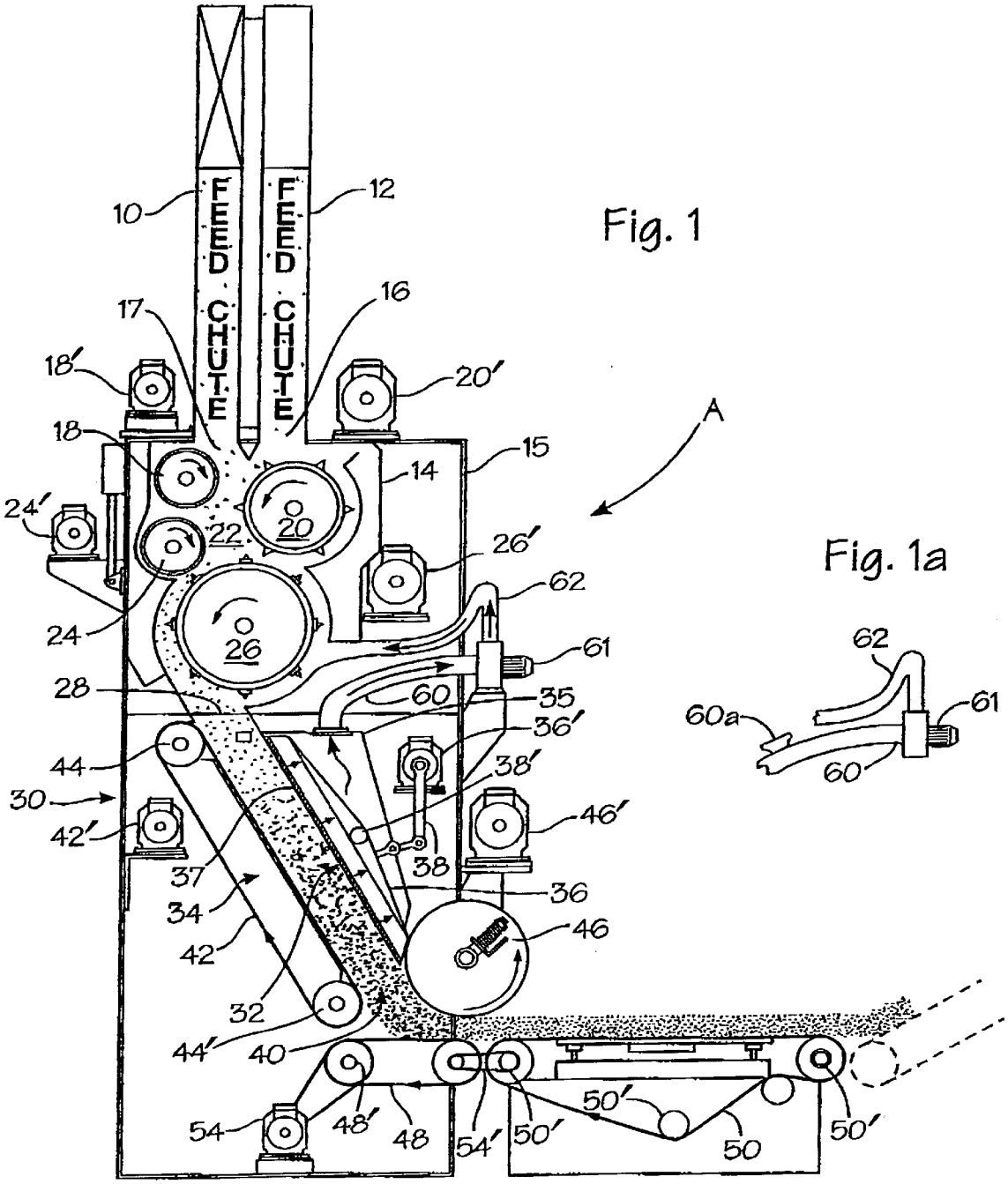
FIG. 1 is a side view of a first arrangement of a fiber web forming apparatus of the invention.
FIG. 1*a* is a cutaway sectional view of the arrangement of FIG. 1 in which a distributor has been added to the air flow inducing structure.

Turning now to the drawings, in FIG. 1 a first arrangement A of the apparatus for transforming fibers into a non-woven fiber web or fabric is shown. The system begins with a fiber feed system substantially as disclosed in co-pending applications Ser. Nos. 09/760,925 and 09/505,922 which may include carding machines of any known type which may be arranged side by side or in parallel. The fibers fed through each machine may be maintained separated during this phase of the operation. It is noted that other types of fiber opening apparatus, such as air lay openers, may be substituted for the carding machines.

Doffers, such as roll doffers or air doffers, are connected with doffing machines to withdraw the carded fibers from the carding roll and deposit them onto a transport. It is noted that it is preferred both doffers be of the same type, however, this is not necessary.

The transports deliver the carded and doffed fibers into a reserve supply which acts to further blend the fibers and also to provide a constant supply of fibers for the next phase of the operation. Transports deliver the fibers from the reserve supplies to respective of feed chutes 10, 12 in the manner described in the afore referred to parent applications.

The transports may be in the form of conveyor belts or they may be in the form of air ducts. Fans may be provided to generate the air current to carry the fibers through the transports.

Feed chutes 10, 12, as shown in FIG. 1, are connected with housing 14 which is formed within a cabinet 15.

Fiber discharge openings 16, 17 are arranged in the upper surface of housing 14. Feed roll 18 is located adjacent opening 17 and rotates in a clockwise direction. Feed roll 20 is located adjacent opening 16 and rotates in a counter clockwise direction. Preferably, the diameter of feed roll 18, which is about 6 inches in diameter, is about half the diameter of feed roll 20.

Feed rolls 18 and 20 are driven by independent drive motors 18', 20' which are each controlled to selectively drive the feed rolls at selected RPM's. The speed selected is determined by sensors which usually control feed rolls 18 and 20 to have the same peripheral speed. A median peripheral speed for feed rolls 18 and 20 is between 0 and 20 m/min. In cases where the mixture of fibers from chutes 10 and 12 is to be unequal, the relative peripheral speed between rolls 18 and 20 is adjusted to obtain the desired mixture.

The feed rolls deliver the fibers into mixing chamber 22 where they are further opened and blended. At the lower end of mixing chamber 22 there is located a combing roll 24 and a beater roll 26. Combing roll 24 along with feed roll 20 act to pick up fibers in the mixing chamber and wipe them onto the outer surface of beater roll 26. The beater roll in turn acts to further open and blend the fibers as they are moved through the beater chamber during delivery into receiving end 28 of forming chute 30.

Comber roll 24 and beater roll 26 are driven by motors 24' and 26' at selected speeds. The selected speed chosen for each of rolls 18, 20, and 26 is determined by the fiber blend desired and by the fiber volume necessary to form the fiber batt or non-woven fabric at the desired density and weight in forming chute 30.

The peripheral surfaces of feed rolls 18, 20, of comber roll 24 and of beater roll 26 are formed of pin like members of usual construction. Normally, the pins are arranged in parallel transverse rows, however in the case of at least feed roll 20, it has been found to be desirable to arrange the pin rows in a helical pattern. Such a pattern of teeth acts to more evenly wipe the fibers onto beater roll 26.

Forming chute 30 is of usual rectangular shape with an upper wall 32 and a lower wall 34 spaced by a pair of equal sized sides. Upper wall 32 includes a housing 35, one side of which comprises vibrating plate 36. Vibrating plate 36 extends across the width of upper wall 32 and lengthwise of forming chute 30 from adjacent the upper end of wall 32 to the lower end of forming chute 30. Vibrating plate 36 forms the upper surface of discharge or delivery end 40 of the batt forming chute. Vibrating plate 36 is driven in a rocking motion about pivot 38' by motor 36' through linkage 38. The structure of chute 30 is maintained by vibrating plate 36 remaining a relatively constant position relative to lower wall 34.

Hood 35 has connected with a side wall remote chute 30 a conduit 60 which connects with blower or fan 61. A second conduit 62 connects blower 61 with housing 14 and mixing chamber 22. Lower surface 37 of vibrating plate 36 is perforated as indicated by the arrows. This structure allows blower 61 to force air in the direction of the arrows creating the following scenario.

An air flow may be forced through conduit 62 into mixing chamber 22. The velocity of the air flow is lower than the velocity of beater roll 26 and plays no significant roll in moving the blended and opened fibers through receiving end 28 of chute 30. As the air flow moves through chute 30 it acts to move or urge the fibers toward the upper side of chute 30 which assist in more evenly distributing the fibers preventing compacting toward the lower area of the web adjacent chute wall 34 by the movement of packing belt 42. The air flow further helps to maintain the fibers oriented in all directions which provides for greater stability for the fiber web.

As the air flow moves down chute 30 it is drawn through the openings in upper wall 32 and vibrating plate 36 and into hood 35. From the housing the air is circulated back to blower 61 through conduit 60 where the cycle is repeated.

The velocity of the air flow is preferably lower than the fiber velocity created by beater 26 with preferred velocity lower than 1 meter/second and the pressure of the air flow is between 1–50 millimeters water gauge.

If desired the air flow assembly may include a distributor 60*a* connected with conduit 60 as shown in FIG. 1*a*. The distributor may be utilized to add chemicals into the air flow which can act to reduce the static load or charge in the fibers during passage through forming chute 30. The chemicals may alternatively act to reduce flamability of the fiber web, increase or bring about the bonding capability of the fibers or produce other desired characteristics.

Any known type of distributor may be utilized to carry the fiber conditioner. It could comprise heated or cooled air.

Another capability of distributor 60*a* could be to increase the humidity temperature within cabinet 15.

It is noted that the location and size of fan 61 may be varied as desired. Also, the location of conduits 60, 62 may also be changed to other areas of cabinet 14 and housing 35. The air system may be a closet loop system or it may be an open loop system.

Lower wall 34 carries packing belt 42 which extends over substantially its entire area. Packing belt 42 which is continuous, passes around roller 44 which is arranged near the upper end of lower wall 34 and around the roller 44' which is arranged at delivery end 40 of the batt forming chute. Motor 42' drives roller 44 and packing belt 42 in a clockwise direction. The packing belt acts along with the just described air flow to physically assist the movement of the fibers from receiving end 28 down the forming chute forming the fiber web or non-woven fabric fibers. The air flow may, if desired, also act to physically treat the fibers as earlier described. The fiber orientations are more evenly maintained throughout the batt forming chute. Also, the fiber density throughout the fiber web is more evenly maintained between the bottom and top surfaces of the fiber web.

Compression roll 46, which is driven by motor 46', acts to compress and draw the formed fiber batt out of delivery end 40 of the batt forming chute.

It is the combined operations of vibrating plate 36 and packing belt 42 which draw and urge sufficient quantities of fibers toward delivery end 40. The fiber volume can be controlled by the speed of the vibrator plate, the air velocity, and the speed of the packing belt. Compression roll 46 acts on the formed fiber web to compact it to a desired height providing a non-woven fabric or fiber web with desired entanglement, body, weight, and height.

A conveyor belt 48, arranged adjacent delivery end 40 receives the fiber web emerging from the delivery end. Conveyor belt 48, which passes around rollers 48', acts as a back wall against the force exerted by compression roll 46 and further acts as a delivery belt for moving the formed fiber web onto conveyor belt 50.

Conveyor belt 50 passes about rollers 50'. Motor 54 which is connected with a roller 48' also drives conveyor belt 50 through drive belt 54'.

Mounted intermediate rollers 50' is a scale which acts to weigh the fiber batt emerging from delivery end 40 as it is moved over conveyor belt 50. The weight of the formed fiber web or non-woven fabric is sent to a control which calculates its density and compares this density to a norm. The operation of compressor roll 46, conveyor belts 48, along with the scale and control are fully described in co-pending application with Ser. No. 09/505,922.

Figure 2:
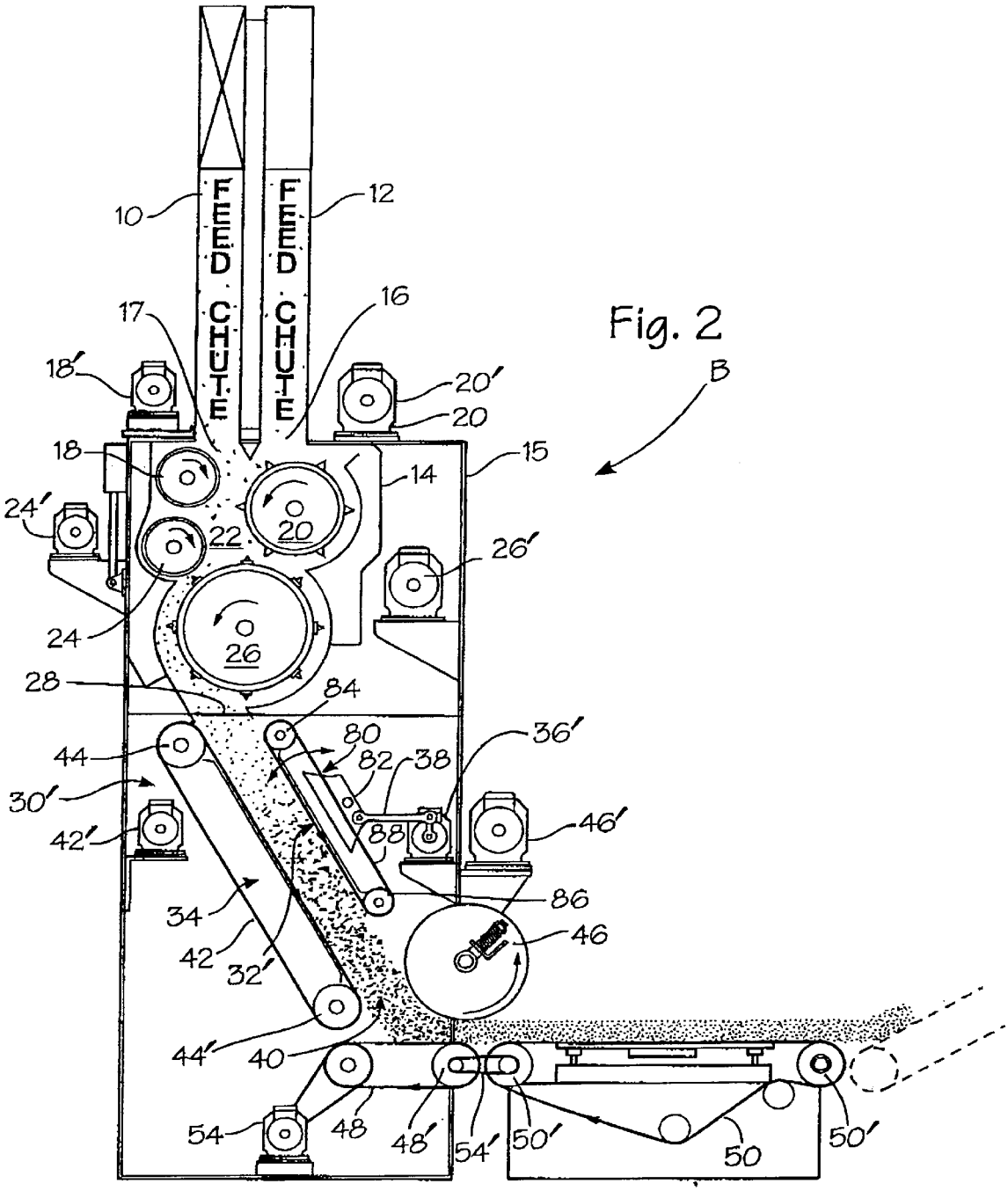
FIG. 2 is a diagrammatic view of a second arrangement of a fiber web forming apparatus of the invention; and, FIG. 3 is a diagrammatic view of a third arrangement of a fiber web forming apparatus of the invention.

Turning now to FIG. 2, a second arrangement B is shown for controlling the opened and blended fibers as they are fed from chamber 22 through receiving end 28 into web forming chute 30'. It is noted that all like components of the arrangements shown in FIGS. 1 and 2 are like numbered while differing components are numbered independently.

Again, the movement of the opened fibers into the chute is assisted by packing belt 42 along the lower surface of chute 30'. Vibrating plate 80, oscillated about pivot 82 by linkage 38 form the upper surface of chute 30'. The vibrator plate carries at its opposed ends a pair of rollers 84, 86 about which continuous belt 88 passes. Roller 84 may be power driven by a suitable drive motor not shown which is controlled in the manner of motor 36' to drive belt 88 in a counterclockwise direction during operation of the vibrating plate.

Again, the combined operation of packing belt 42, vibrating belt 88, and vibrating plate 80 act to more evenly move the fibers into and through chute 30. The combined actions of vibrator plate 80 and vibrating belt 88 assist in bringing about more equal vertical density and fiber orientation of the fibers forming the fiber web. Also, by controlling the speed of the belts, the total density and weight of the web may be controlled as desired.

In the described arrangement, the fibers pass from feed chutes 10, 12 through chamber 22 as previously described.

As the fiber web or non-woven fabric exits delivery end 40 it passes between compression roll 46 and belt 48 and along belts 48 and 50 as previously described.

It is noted that the air arrangement shown in FIG. 1 or 1*a* may be incorporated with the fiber batt forming arrangement shown in FIG. 2.

Figure 3:
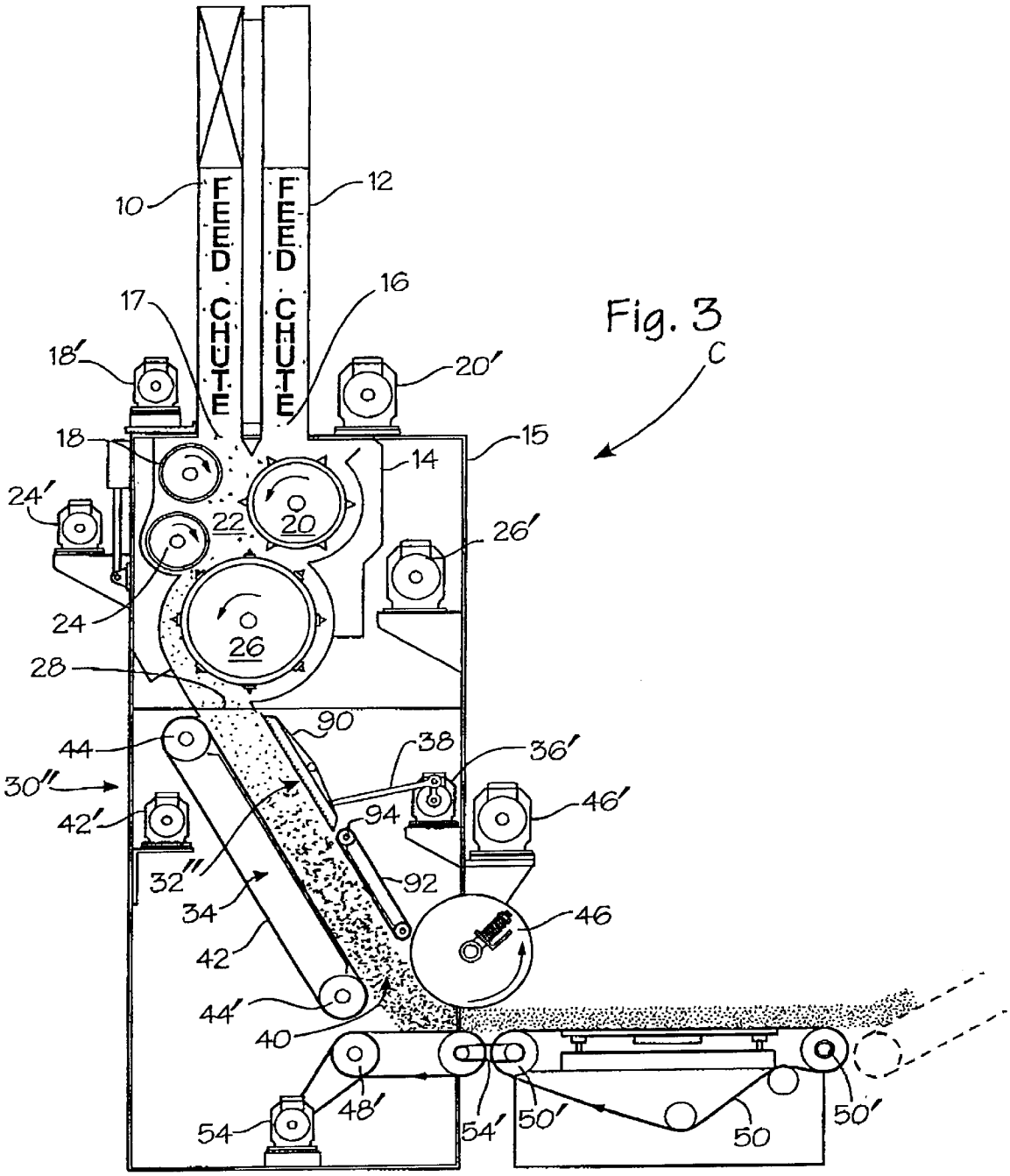

Turning now to FIG. 3, a third arrangement C of the invention is shown. Again, like components with the arrangement shown in FIG. 1 are like numbered.

In FIG. 3, the opened fibers move through feed chutes 10 and 12 as they are drawn into chamber 22 by feed rolls 18 and 20. Combing roll 24 along with feed roll 20 act to wipe the opened fibers onto the beater roll 26 which further opens and blends the fibers as they are passed into forming chute 30". Lower wall 34 extends from receiving 28 to delivery end 40 and comprises along a major portion of its length packing belt 42. Packing belt 42 is driven in the direction of the arrow and acts to assist the movement of the opened fibers into and through forming chute 30'. Upper wall 32" extends substantially parallel of lower wall 34 and includes a vibrating plate 90 driven by way of a suitable linkage 38 and motor 36' in the manner described of the arrangement in FIG. 1. Vibrating plate 90 is of a width substantially equal that of chute 30" but its length is only about half that of the chute.

Alternatively, plate 90 could be incorporated with an air flow arrangement as shown in FIGS. 1 or 1*a*.

Arranged adjacent the end of vibrating plate 90 is an upper packing belt 92 which is driven by rotating rolls 94 in the direction of the arrow. Rollers 94 are driven also by motor 36' or by an independent drive controlled for selective speed. All drive motors are connected with and controlled by a control as set forth in the parent application.

Packing belt 92 and vibrating plate 90 are about equal in length with belt 42 forming the remainder of the upper wall 32". Its lower end terminates adjacent compression roll 46 and delivery end 40.

Alternatively, the air circulation arrangement shown in FIGS. 1 and 1*a* could be incorporated with both or with either vibrating plate 90 and packing belt 92.

The fibers are fed and oriented along random axes in an evenly distributed manner throughout forming chute 30".

As the formed non-woven fabric or fiber batt moves through delivery end 40 it is acted on by compression roll 46 in the manner previously set forth.

The arrangements described and shown in FIGS. 1, 1*a*, 2, and 3 are operative to produce lightweight fiber webs of no more than 100 grams per square meter or high weight fiber webs of up to 4000 grams per square meter. The density between fiber webs is controlled by its height relative to its weight.

The arrangements described above are capable of receiving and providing a supply of carded, opened, and blended fibers to the fiber web or non-woven fabric forming machine at controlled rates and at controlled machine speed. The arrangement provides for an increased rate in production of non-woven webs of selected weights, densities, and heights. The fibers are more evenly blended and the fiber directions are oriented in all directions providing for a more stable, more sturdy, and more resilient product. Also, non-woven webs of up to seven meters wide are capable of being produced with the disclosed system.

The systems are ideal for preparing fibers which are all natural, all synthetic, or blends of natural and synthetic. Also, the fibers may be virgin fibers or regenerated fibers.

While preferred arrangements of the invention has been described using specific terms, such description is for illustrative purposes only, and it is to be understood that changes and variations may be made without departing from the spirit or scope of the following claims.

What is claimed is:

1. An arrangement for forming a non-woven fiber web with high resilience and high loft comprising:

a cabinet receiving opened and blended fibers from a feed;

an upwardly directed fiber web forming chute receiving said opened and blended fibers for forming a non-woven fiber web, said forming chute having an upper wall including a vibrating plate and a lower wall including a packing belt for urging said fibers down said forming chute in an evenly distributed condition throughout the height of said fiber web being formed;

an air distribution system delivering air flow through said forming chute for assisting in controlling the distribution and movement of said fibers within said forming chute, said air flow exiting said forming chute through said upper wall; whereby, said fibers are formed into a fiber web of substantial equal density and weight along its height and length.

2. The arrangement of claim 1 wherein said upper wall includes a hood for receiving said air flow through said upper wall.

3. The arrangement of claim 2 wherein said vibrating plate is perforated allowing said air flow to migrate through said vibrating plate.

4. The arrangement of claim 2 wherein said hood is located over said vibrator plate.

5. The arrangement of claim 1 wherein said air distribution system includes an outlet conduit delivering said air flow into said cabinet and to a receiving end of said forming chute and an intake conduit removing said air flow for said cabinet.

6. The arrangement of claim 1 wherein said air distribution system includes a feed for supplying said air flow with one of moisture and chemical additive whereby said fibers within said forming chute are coated.

7. The arrangement of claim 6 wherein said air distribution system includes one of a heating element and a cooling element for controlling the air temperature.

8. An arrangement for forming a non-woven fiber web with high resilience and high loft comprising:

a housing delivering blended and opened fibers into a receiving end of a fiber web forming chute;

said forming chute including an upper wall and a lower wall spaced a distance equal the loft of the fiber web;

said upper wall comprising a vibrating plate positioned adjacent an upper packing belt, said vibrating plate and upper packing belt each extending across the width of said forming chute and in tandem along the length of said forming chute;

said lower wall including a fiber movement assisting element; wherein, said fiber movement assisting element, said vibration plate and said upper packing belt cooperate to move said fibers within said forming chute to form a non-woven fiber web in which the fibers are oriented in all directions with substantial equal density throughout the non-woven fiber web.

9. The arrangement of claim 8 wherein said vibrating plate is located adjacent said receiving end.

10. The arrangement of claim 8 wherein said upper packing belt is located adjacent a delivery end of said forming chute.

11. The arrangement of claim 8 including an air system providing an air flow through said housing and said forming chute.

12. The arrangement of claim 11 including an air return associated with said upper wall.

13. The arrangement of claim 11 wherein said upper packing belt extends along substantially the entire length of said upper wall.

14. The arrangement of claim 11 wherein said vibrator plate extends along substantially the entire length of said upper wall.

15. The arrangement of claim 11 wherein said vibration plate carries said upper packing belt.

16. The arrangement of claim 8 wherein said fiber movement assisting element is a packing belt.

17. The arrangement of claim 16 including an air system providing an air flow through said housing and forming chute.

18. The arrangement of claim 16 wherein said air system is open end.

19. An arrangement for forming a non-woven fiber web with high resilience and high loft comprising:

a housing delivering opened and blended fibers into a receiving end of an upwardly extending fiber web forming chute;

said forming chute having an upper wall spaced from a lower wall by a distance equal the loft of said fiber web;

said lower wall having a packing belt extended across the width of said forming chute and substantially along the entire length of said lower wall;

said upper wall comprising a vibrating plate and an upper packing belt extending across the width of said forming chute and along the length of said upper wall; wherein, said upper packing belt, said vibrator plate and said packing belt cooperate to move said fibers toward a delivery end of said forming chute forming a non-woven fiber web with fibers oriented in all directions and distributed evenly throughout the non-woven fiber web.

20. An arrangement for forming a non-woven fiber web with high resilience and high loft comprising:

a housing delivering opened and blended fibers into a receiving end of an upwardly extending fiber web forming chute;

said forming chute having an upper wall spaced from a lower wall by a distance equal the loft of said fiber web;

said lower wall having a fiber movement assisting member extended across the width of said forming chute and along the its length;

said upper wall comprising a fiber movement assisting member extending across the width of said forming chute and its length of said upper wall;

said fiber movement assisting members comprising at least one of a vibrating plate and a packing belt;

an air distribution system connected with said housing delivering a controlled air flow through said forming chute for further assisting in the movement and distribution of said fibers; wherein, said fibers are maintained evenly distributed and randomly oriented as they are moved through said forming chute and compacted into a non-woven fabric.

21. The arrangement of claim 20 further including a feed associated with said air distribution system, said feed being adapted to combine one of moisture and chemical additive with said air flow for conditioning said fibers.

* * * * *